US005600994A

United States Patent [19]

Venäläinen

[11] Patent Number: 5,600,994

[45] Date of Patent: Feb. 11, 1997

[54] STRAIGHTENING BEAM

[75] Inventor: Olavi Venäläinen, Kuopio, Finland

[73] Assignee: Autorobot Finland KY, Kuopio, Finland

[21] Appl. No.: 133,091

[22] PCT Filed: Apr. 7, 1992

[86] PCT No.: PCT/FI92/00106

§ 371 Date: Oct. 8, 1993

§ 102(e) Date: Oct. 8, 1993

[87] PCT Pub. No.: WO92/18263

PCT Pub. Date: Oct. 29, 1992

[30] Foreign Application Priority Data

Apr. 9, 1991 [FI] Finland ..... 911686

[51] Int. Cl.[6] ..... B21D 1/12

[52] U.S. Cl. ..... 72/447; 72/705

[58] Field of Search ..... 72/705, 457, 447

[56] References Cited

U.S. PATENT DOCUMENTS

| | | | |
|---|---|---|---|
| 3,122,194 | 2/1964 | Bronson et al. | 72/705 |
| 3,276,237 | 10/1966 | Transue . | |
| 3,340,720 | 9/1967 | Chartier . | |
| 3,689,030 | 9/1972 | Backus | 72/705 |
| 3,835,692 | 9/1974 | Hoffman | 72/705 |
| 4,257,255 | 3/1981 | Sanchez | 72/705 |
| 4,574,613 | 3/1986 | Doughty . | |
| 4,592,225 | 6/1986 | Eck . | |
| 4,761,984 | 8/1988 | Fuscaldo, Jr. | 72/705 |

FOREIGN PATENT DOCUMENTS

| | | |
|---|---|---|
| 0163216 | 7/1986 | European Pat. Off. . |
| 0361410 | 4/1990 | European Pat. Off. . |
| 53930 | 5/1978 | Finland . |
| 900581 | 2/1990 | Finland . |
| 2132021 | 4/1980 | Germany . |
| 304230 | 1/1969 | Sweden . |
| 7109164 | 3/1977 | Sweden . |

*Primary Examiner*—Lowell A. Larson
*Attorney, Agent, or Firm*—Cushman, Darby & Cushman

[57] ABSTRACT

The invention concerns a straightening beam for an automotive bodyshell straightening jig, said straightening beam comprising a vertical beam (1), which is sideways rotatable attached to a beam base (11), which is detachably mountable to the frame of the automotive bodyshell straightening jig, and the beam further incorporating guidance means (2) for guiding a pulling tool member (3) attachable to the automotive bodyshell and for adjusting the position of the pulling tool member. With prior-art apparatuses it is not always possible to bring the pulling tool member sufficiently close to the point to be pulled or to exert the full power of the actuator via the pulling tool member. The straightening beam according to the invention incorporates an extension beam (4) attached to a vertical beam (1) so as to be rotatable and lockable at various angles. Furthermore, the vertical beam (1) incorporates a power actuator which exerts its force downward along the vertical beam and to which the pulling tool member is attached.

6 Claims, 5 Drawing Sheets

STRAIGHTENING BEAM

Figure 1:
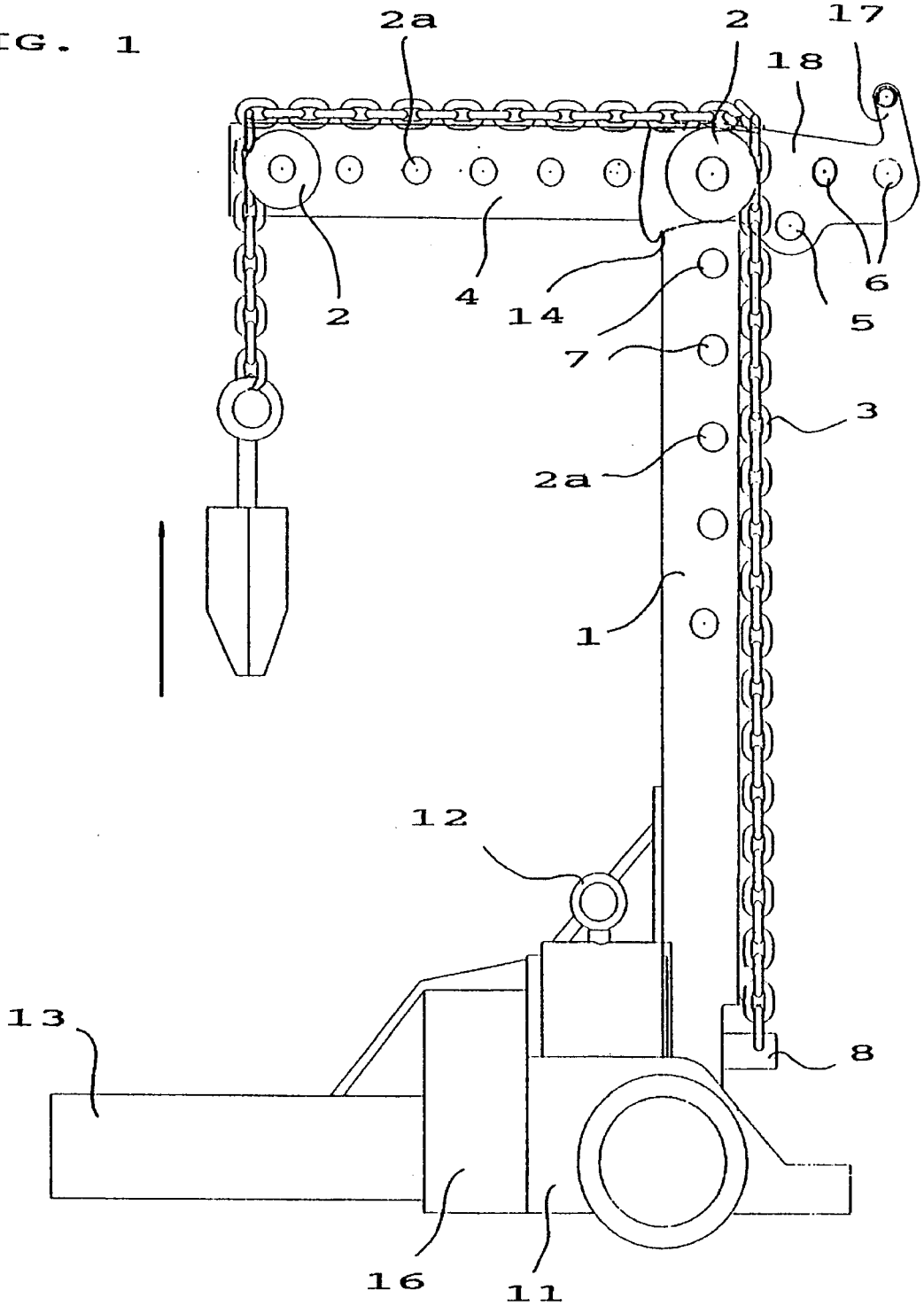

The present invention relates to a straightening beam for an automotive bodyshell straightening jig, said straightening beam comprising a vertical beam, which is sideways rotatably attached to a beam base, which is detachably mountable to the frame of the automotive bodyshell straightening jig, and the beam further incorporating guidance means for guiding a pulling tool member attachable to the automotive bodyshell and for adjusting the position of the pulling tool member.

In conventional vehicle bodyshell straightening jigs the vehicle is driven or transferred over the jig frame, after which the vehicle is attached with the help of clamping means to the frame and lifted to a desired elevation. The vertical beam of the jig is moved to a desired working location, after which the beam is rotated to a desired position relative to the vehicle. The guidance means are adjusted to a desired elevation on the vertical beam. The pulling tool member is attached both to the vehicle and via the guidance means to the jig frame, which further is connected to a power actuator. Next, the actuator is energized to apply a force to the pulling tool member as necessary to straighten the bodyshell. In another embodiment of the jig a hydraulic cylinder is employed to pivotally rotate the vertical beam about a shaft with the pulling tool member attached to the beam. A disadvantage in both embodiments is that neither of the jigs is capable of efficiently transferring the entire force exerted by the power actuator to the point to be straightened. Conventional straightening jigs do not generally allow orienting the pulling tool member to act from an exactly correct angle and height to the automotive bodyshell structures. The conventional straightening beams are unable to reach, e.g., the interior of the automotive bodyshell. Use of prior-art straightening jigs for, e.g., lifting purposes also is impossible without additional equipment.

It is an object of the present invention to achieve a straightening beam for an automotive bodyshell straightening jig, said straightening beam permitting the orientation of the pulling tool member to act on the automotive bodyshell in all circumstances from an optimum location, correct angle and correct height with respect to the straightening operation to be performed. Moreover, it is an object of the$_i$ invention to provide a straightening beam capable of applying essentially the entire force exerted by the power actuator to the point to be straightened. Furthermore, it is an object of the invention to provide a straightening beam having a simple construction and function as well as applicability to, e.g., lifting purposes without the need for additional equipment.

The goal set for the invention is attained by a straightening beam comprising a extension beam, which is attached to a vertical beam so as to be rotatable and lockable at various angles. The vertical beam incorporates a power actuator which exerts its force downward along the vertical beam and to which power actuator the pulling tool member is attached. Then, by appropriately placing the vertical beam and the extension beam in desired positions, the pulling tool member can be oriented with the help of the guidance means attached to the vertical beam and/or extension beam to act from a desired direction relative to the automotive bodyshell, thus permitting the entire force of the power actuator to be exerted via the pulling tool member at the point to be straightened. The straightening beam formed by the vertical beam and the extension beam can be adjusted to a desired height and location with respect to the automotive bodyshell, because the vertical beam is sideways rotatably attached to the beam base and the extension beam is in other direction rotatable to the vertical beam. The guidance means can be mounted in appropriate positions on the straightening beam, whereby the pulling tool member can be adjusted to pull the automotive bodyshell from the most advantageous direction. It is also possible to bring the pulling tool inside the vehicle and it is possible to work efficiently there. Because the actuator power is directed downward, the pulling tool member connected to the actuator is moved efficiently and without loss of power. The straightening beam according to the invention has a simple yet effective construction.

The invention is next examined with the help of the attached drawings, in which

Figure 2:
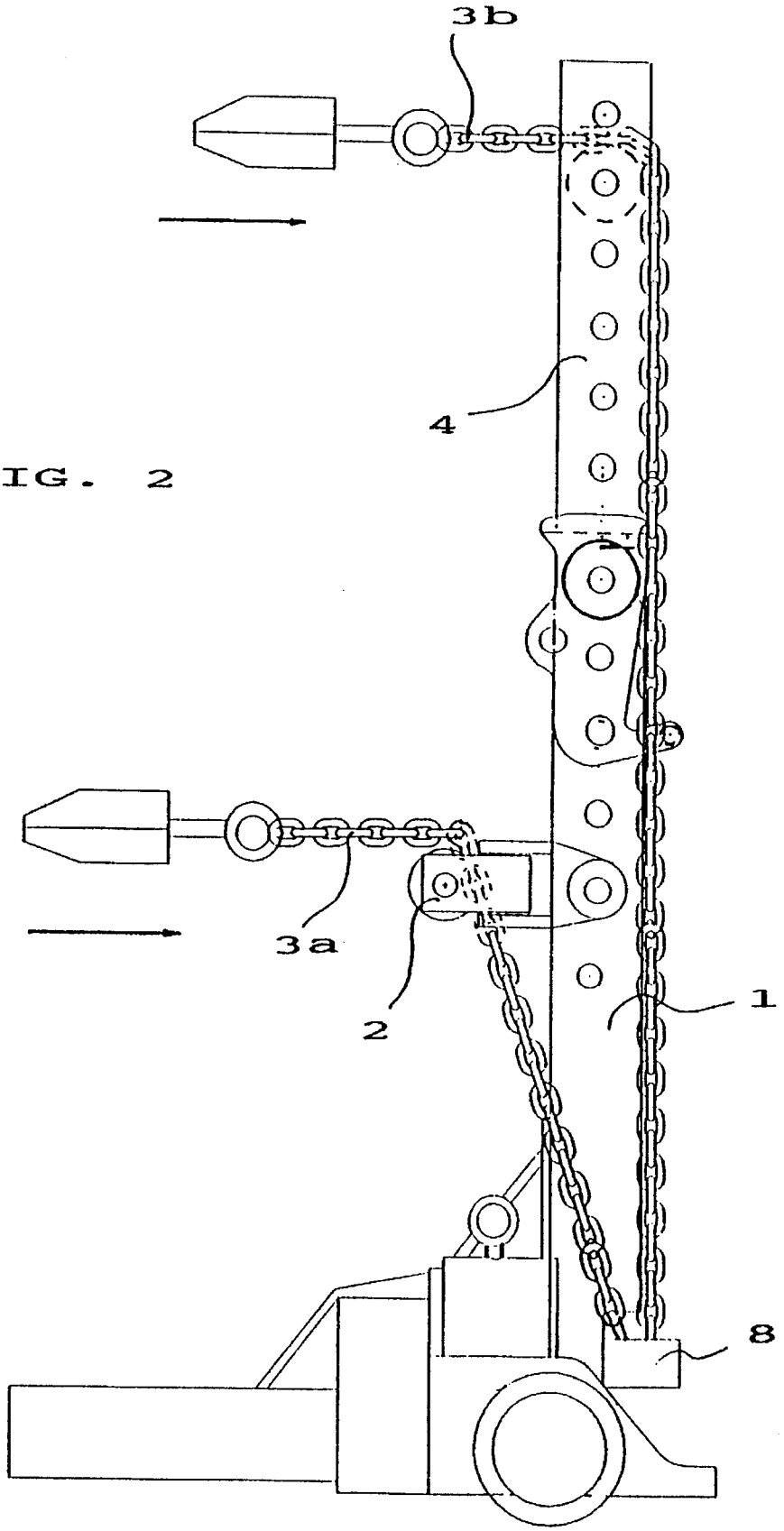
Figure 3:
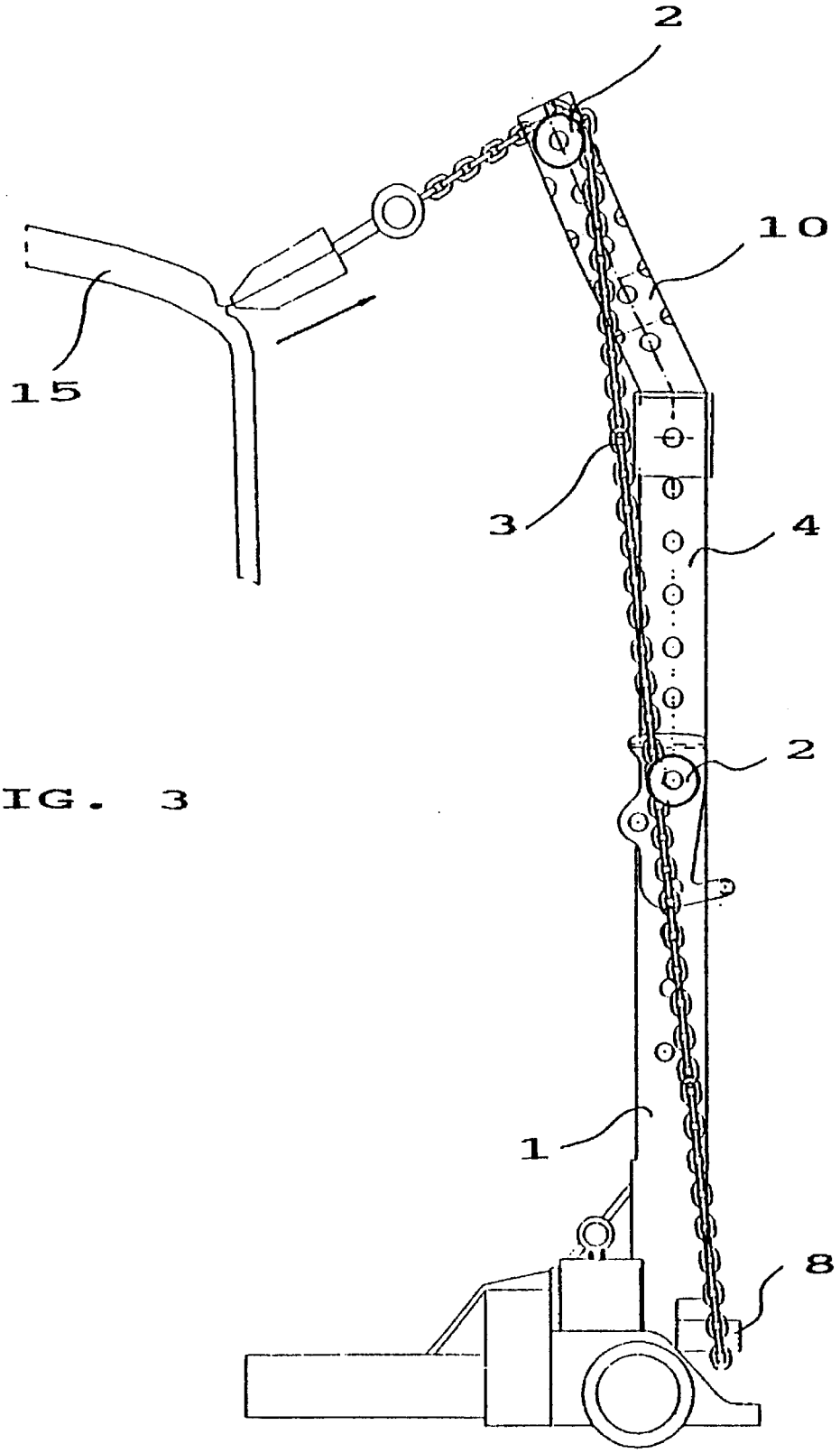
Figure 4:
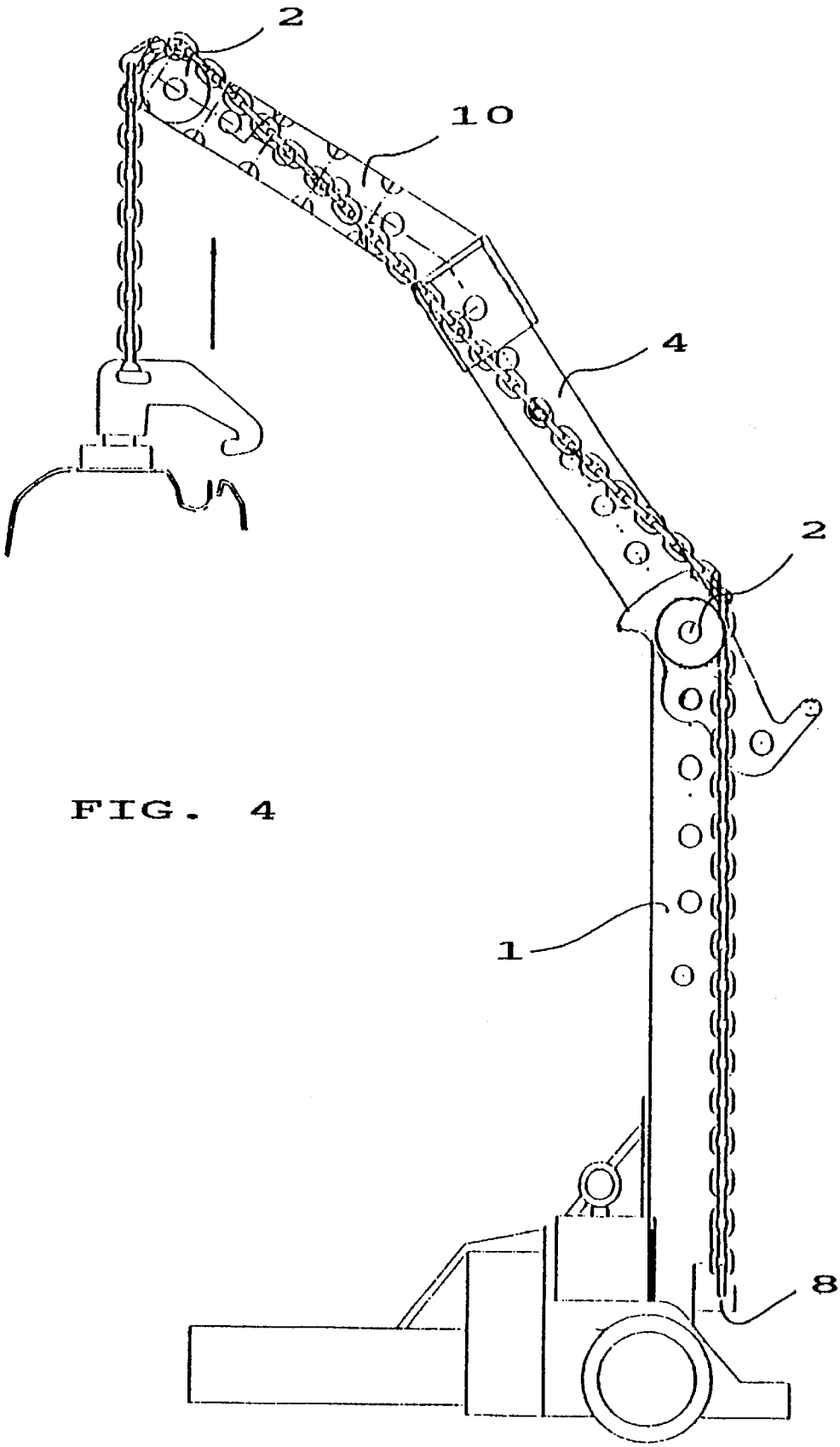
Figure 5:
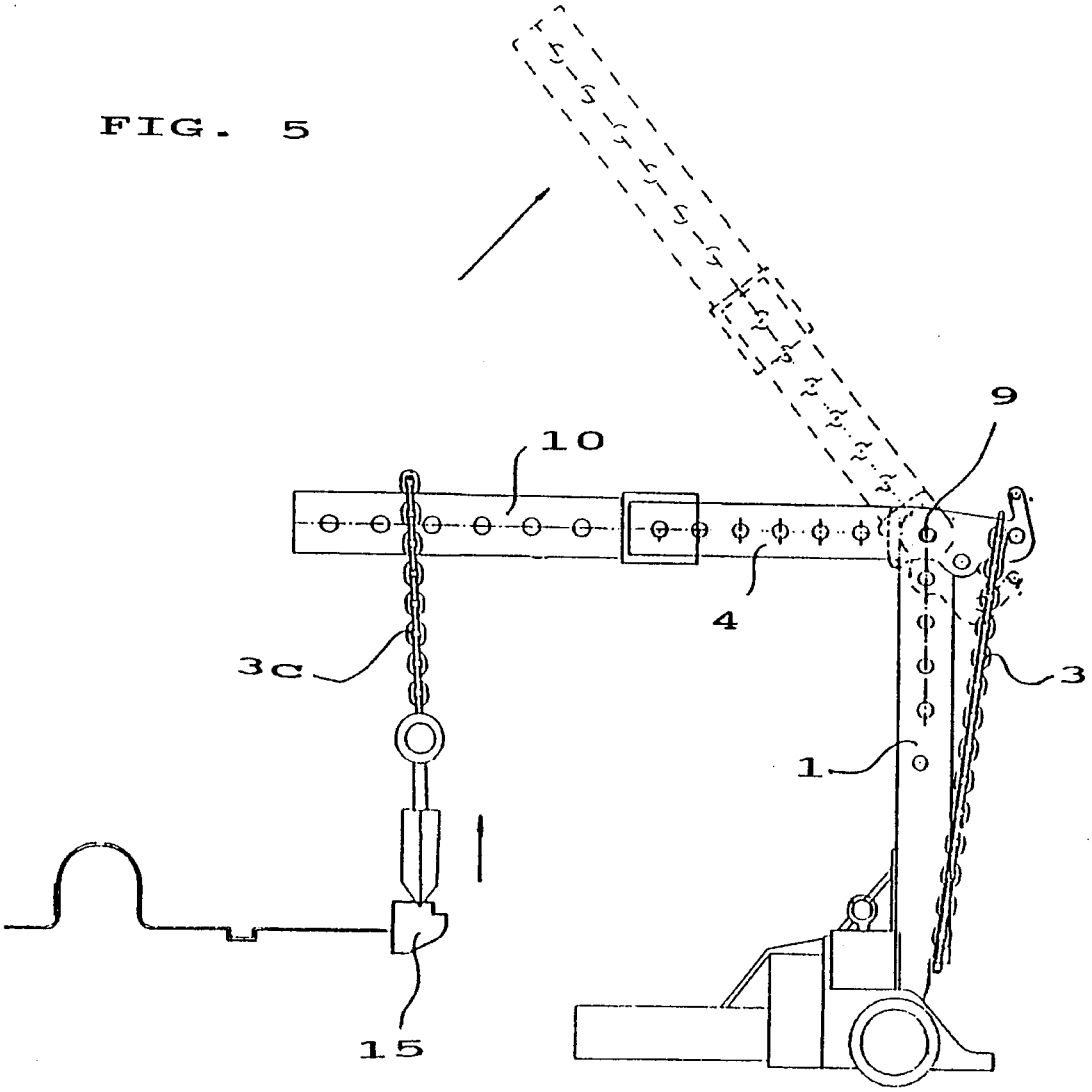

FIG. 1 shows in a side view an embodiment of the straightening beam according to the invention adjusted for a working position, FIG. 2 shows in a side view the straightening beam illustrated in FIG. 1 adjusted for another working position, FIG. 3 shows in a side view another embodiment of the straightening beam according to the invention adjusted for a working position, FIG. 4 shows the straightening beam illustrated in FIG. 3 adjusted for another working position, and FIG. 5 shows in a side view a third embodiment of the straightening beam according to the invention adjusted for a working position.

In the embodiments illustrated in the appended drawings, the straightening beam comprises a vertical beam 1, which has an extension beam 4 pivotally mounted to it, and guidance means 2. The vertical beam 1 is mounted on a beam base 11 and is sideways rotatable with respect to the base and lockable in a desired position and angle with respect to the base with the help of a locking pin 12. The beam base can be mounted to the straightening jig frame by means of a connecting beam 13. The connecting beam is mountable by conventional means to a pivotally jointed part of the straightening jig frame and adjustable at a desired angle with respect to the straightening jig frame.

The extension beam 4 is pivotally mounted to the end of the vertical beam by means of a pivot pin which is inserted through holes provided at the ends of both the vertical beam and the extension beam. FIGS. 1–5 also illustrate a guidance element 2 mounted in the same position. The end of the extension beam is provided with a bracket-shaped member 18, which has holes 5 and 6 as well as a bracket 17, which extends outward from said member. When the straightening beam is in the position illustrated in FIG. 1 having the vertical beam and the extension beam set at 90° angle, the locking pin is inserted through the hole 5, thus locking the extension beam in its place by virtue of the locking pin and the lip 14 of the extension beam. The vertical beam has holes 7 spaced at a suitable distance downward from the upper end of the vertical beam. The hole 5 of the extension beam is located so that an upward 45° rotation of the extension beam aligns the hole 6 with the upper hole 7 of the vertical beam, thus permitting the locking of the beams in this relative position with the help of the locking pin. Correspondingly, the other holes 6 align with the holes 7 when the extension beam is rotated upward at 90° angle, whereby the extension beam can be locked in this position. Thus locked, the beam forms a direct extension of the vertical beam. In the other embodiments of the invention, the locking of the extension beam relative to the vertical beam is also possible at other angles. Correspondingly, the other embodiments are suited to the use of varied pulling tools members. The guidance means 2 in this embodiment are formed by holes **2*a* drilled at suitable spacings from each other on the vertical beam and the extension beam as well as support elements 2** inserted in the holes, said elements being guiding sheaves or chain sprockets. The extension beam in particular can be provided with holes on both sides of the beam thus permitting the mounting of the guidance sheaves in desired positions along the beam. In the other embodiments also different types of conventional guidance means are usable.

The inside of the vertical beam houses a power actuator which can be a hydraulic cylinder (not shown in the diagrams). The hydraulic cylinder is placed to the lower part of the vertical beam in order to bring its point of gravity as low as possible. The end of the hydraulic cylinder carries a glide shoe 8 attached to it extending to the exterior of the vertical beam. The glide shoe has connection attachments for at least two pieces of pulling tool members. The stroke Of the hydraulic cylinder is directed downward parallel with the axis of the vertical beam.

The pulling tool member 3 is any suitable pulling tool such as a roller chain, link chain, cable or a similar element. The tool member is attached at its one end to the glide shoe 8 moved by the hydraulic cylinder and at its other end to a point 15 to be straightened on the automotive bodyshell. The tool member is supported and guided from a desired location and direction relative to the automotive bodyshell with the help of guidance means 2 attached to the vertical beam 1 and/or the extension beam 4.

The beam base 11 of the straightening beam incorporates a connection member 16 for the mounting of a backing member. The connection member is formed by a hollow beam, which is fixed to the beam base. A backing member can be inserted through the connection member and locked, after which the straightening beam is locked in place.

In the application shown in FIG. 1 the extension beam 4 is attached to the vertical beam 1 so that the angle subtended between the beams is 90°. The guidance sheaves are mounted at both the pivot pin and the end of the extension beam. Such an arrangement achieves a high straightening force, because the entire force exerted by the hydraulic cylinder can be focused on the point to be straightened.

FIG. 2 shows an application of the straightening beam for applying the straightening force from two different heights. The extension beam is attached so as to form a straight extension of the vertical beam. The deflecting chain sprocket acting as the second guidance means is mounted on the vertical beam 1, while the guiding sheave performing as the second guidance means is mounted to the end of the extension beam 4. A chain **3*a* performing as the second pulling tool member is placed to act via a chain sprocket on the front side of the straightening beam, while correspondingly another chain 3*b*** is placed to act via another guiding sheave on the other side of the beam. Also the use of two chains in the same plane is possible during the straightening of, e.g., a rocker panel using two pulling tool members.

In the straightening beam shown in FIG. 3 the extension beam 4 is locked in a similar manner as in FIG. 2 to form a straight extension of the vertical beam 1. On the end of the extension beam is further mounted an extension arm 10 which in this application subtends an angle with the extension beam. On the extension arm is mounted a chain sprocket 2 at a suitable height so as to permit the chain 3 to be guided by the chain sprocket. Such an arrangement provides a proper pulling angle for, e.g., straightening the roof structures of an automotive bodyshell. When necessary, the extension beam can be lengthened using two extension arms, whereby the operating height of the straightening beam becomes sufficient for straightening the bodyshells of vans, also. The extension arm(s) can, of course, similarly be attached to the ends of extension beams illustrated in the other diagrams. Thus, e.g., the straightening beam shown in FIG. 1 can be made to reach the center of an automotive bodyshell from both its interior and exterior, whereby the straightening beam can be brought close to the point to be straightened and the pulling tool member can be attached at an exactly correct angle with respect to the point to be straightened.

In the application shown in FIG. 4 the extension beam 4 is locked at a 45° angle and its end is provided with an angled extension arm 10. This arrangement makes it possible to perform straightening operations so that the vertical beam can be placed farther away than in the above-described applications. In applications which make no use of an extension arm the guiding sheave is mounted on an adjacent side,of the extension beam to that shown for the guiding sheave in the diagram. This arrangement permits orienting the pulling tool member orthogonally away from the beam.

In the application shown in FIG. 5 the extension beam 4 is not locked to the vertical beam 1, but rather, is pivotally rotatable about a pivot pin 9. The end of the extension beam has an extension arm 10 attached to it, in this case a straight arm. The first pulling tool member, advantageously a roller chain 3, is attached to the bracket formed to that end of the extension beam which is closer to the vertical beam. A second pulling tool member **3*c* is fixed to the other end of the extension arm and clamped to a point 15 to be straightened. When a force is actuated by means of the first pulling tool member to the first end of the extension beam, its other end is rotated upward, thereby lifting the pulling tool member 3*c*** along. This configuration is suited to pulling operations not requiring greater force. Such pulling operations are involved in, e.g., the straightening of hoods and doors. In this embodiment the apparatus is also applicable to the hoisting and transfer of goods, after the straightening beam is separated from the frame of the straightening jig.

The invention is not limited to the preferred embodiments described above, but rather, can be varied within the scope of the invention disclosed in the appended claims.

I claim:

1. A straightening beam for an automotive body straightening jig, comprising:

a base beam constructed and arranged to be mounted to a frame of the straightening jig;

a vertical beam attached to said base beam for sideways rotatable movement with respect thereto;

a pulling tool member constructed and arranged to be attached to an automobile bodyshell;

guide means for guiding and adjusting the position of the pulling tool member;

an extension beam attached to the vertical beam in such a manner so as to be rotatable and lockable at different angular positions with respect thereto, the extension beam being pivotally mounted to the vertical beam by a pivot pin;

an actuator operatively associated with said vertical beam and coupled to said pulling tool member, said actuator being constructed and arranged to exert a force downwardly along said vertical beam;

at least two locking elements constructed and arranged to lock the extension beam in a desired position relative to said vertical beam;

whereby when placing and locking said vertical beam and extension beam in desired positions, said pulling tool member can be oriented by use of said guide means to act from a desired direction relative to the automotive bodyshell so as to permit an entire force of the actuator to be exerted via the pulling tool member at a point on the automotive body shell to be straightened.

2. A straightening beam as defined in claim 1, wherein the actuator is a hydraulic cylinder, which is placed in an interior portion of the vertical beam at a lower end thereof, said actuator carrying a glide shoe that extends to an exterior of the vertical beam, said glide shoe being movable along the vertical beam and having attachments for the pulling tool member.

3. A straightening beam as defined in claim 2, wherein the glide shoe of the actuator has attachments for at least two pieces of pulling tool members.

4. A straightening beam as defined in claim 1, wherein the beam base of the straightening beam incorporates a connection member for the mounting of a backing member, thereto.

5. A straightening beam as defined in claim 1, wherein the pulling tool member is attached to an end of the extension beam which is closer to the vertical beam, whereby the extension beam can be used as derrick.

6. A straightening beam as defined in claim 1, further comprising at least one extension arm which is detachably mountable to a distal end of the extension beam.

* * * * *